US005850767A

United States Patent [19]

Newman

[11] Patent Number: 5,850,767

[45] Date of Patent: Dec. 22, 1998

[54] RATCHET REVERSING MECHANISM

[75] Inventor: David P. Newman, Arvada, Colo.

[73] Assignee: Camax Tool Co., Arvada, Colo.

[21] Appl. No.: 517,268

[22] Filed: Aug. 21, 1995

Related U.S. Application Data

[63] Continuation-in-part of Ser. No. 86,653, Jul. 6, 1993, abandoned.

[51] Int. Cl.[6] ..... B25B 13/46

[52] U.S. Cl. ..... 81/58.3; 81/63.1

[58] Field of Search ..... 81/58, 58.3, 58.4, 81/59.1, 60, 63.1

[56] References Cited

U.S. PATENT DOCUMENTS

| | | | |
|---|---|---|---|
| 1,321,005 | 11/1919 | Bowman | 81/58.3 |
| 4,030,384 | 6/1977 | Newman | 81/58.3 |
| 4,187,746 | 2/1980 | Shebalm | 81/58.3 X |
| 4,939,961 | 7/1990 | Lee | 81/58.3 X |

FOREIGN PATENT DOCUMENTS

| | | | |
|---|---|---|---|
| 512138 | 1/1921 | France | 81/58.3 |

*Primary Examiner*—D. S. Meislin

*Attorney, Agent, or Firm*—Joseph G. Neuman

[57] ABSTRACT

An improved ratchet mechanism for box end wrenches or similar devices consisting of a driver ring with cam teeth on one face, a driven ring fixed to a socket member rotatably confined in the driver ring, the socket member having a wrench configuration in its interior, and a pawl ring rotatably supported on the socket member. The pawl ring has cam teeth cooperating with the driver cam teeth and the pawl ring and the driven ring have shorter interfitting teeth. The cam teeth have sufficient rise to hold the short teeth engaged when the driver ring is rotated one way, and to allow the shorter teeth to disengage when the driver ring is rotated the other way. A means for directly applying axial forces to engage the sloping faces of the cam teeth of the pawl ring and the driver ring thereby tending to encourage meshing of the driven teeth of the socket member and the driving teeth of the pawl ring in the form of a spring is positioned between the driver ring and the retainer ring. In addition, an angular force feature or first tongue is provided with essentially perpendicular faces, and in conjunction with the complementary cam surfaces there is provided an essentially perpendicular angular force feature or second tongue. The lengths of angular force features are chosen such that when the ratchet teeth are engaged, axial clearance available will be sufficient to permit the angular force features to slip past each other.

3 Claims, 4 Drawing Sheets

RATCHET REVERSING MECHANISM

CROSS-REFERENCE TO RELATED APPLICATION

This application is a continuation-in-part of U.S. patent application Ser. No. 08/086,653 filed 6 Jul. 1993, now abandoned.

BACKGROUND OF THE INVENTION

The present invention relates to ratchet mechanisms and more particularly to simplified functionality of mechanisms which can be incorporated into each of a number of wrenches of graduated size, as disclosed in U.S. Pat. No. 4,030,384 which is commonly owned with this application. More particularly, the present invention relates to an improvement to such a wrench mechanism which permits reversal of torque application direction without removal, re-orientation (flipping) and re-installation of the wrench.

Difficulties have arisen when a threaded fastener, in the process of being removed from a mating object, has occupied the clearance space above itself and the object while still threadably engaged, thereby preventing removal of the wrench. In such circumstances, it is desirable to reverse the direction of torque application in order to re-establish clearance and remove the wrench. In general use, it is also sometimes convenient to place a ratchet wrench upon a bolt or nut to which torque is to be applied prior to choosing the torque application direction, saving the time of tool examination prior to usage.

While the earlier mechanism described in U.S. Pat. No. 4,030,384 serves well in the majority of applications, still, maximum efficiency and more universal application proved limited by the requirement of flipping the wrench over to reverse torque.

Accordingly, there is a need for a simple, yet reliable way to accomplish torque reversal without requiring wrench flipping.

SUMMARY OF THE INVENTION

The present invention provides a novel simplified means for reversing torque application direction without flipping the wrench. Such reversing means is provided by the combination and interaction of oppositely sloped cam teeth on the modified Driver and Pawl Ring (components described in U.S. Pat. No. 4,030,384), and the addition of angular force features. The pawl ring and socket ratchet teeth are modified to have essentially equally sloped surfaces on both faces to permit functioning in both directions, as determined by which cam teeth engage, in turn determined by the angular force features.

The primary objective of this invention is to provide a simple means of torque direction reversal without wrench removal, such means affective by directing angular force to the pawl ring in relation to the driver ring, thereby determining which rotation direction activates cam tooth interaction between the driver ring and pawl ring.

The relationship of the angular force features determines which mating cam teeth of the driver and pawl ring will engage in torque application, and insures that, as the mechanism is subjected to ratcheting in the direction opposite to torque application, the pawl ring will be rotatably carried with the driver without opposite cam teeth engagement, allowing the ratchet teeth to disengage and ratcheting to take place.

Other objects and advantages of the invention will be apparent from the following description, and the accompanying drawings and the appended claims.

DESCRIPTION OF THE PREFERRED EMBODIMENT

Figure 1:
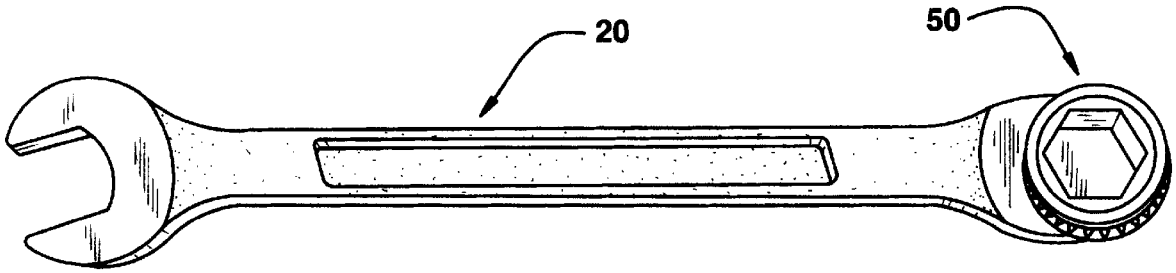
FIG. 1 is a view of a typical wrench embodying the ratchet mechanism incorporating the improvement of the present invention.
Figure 2:
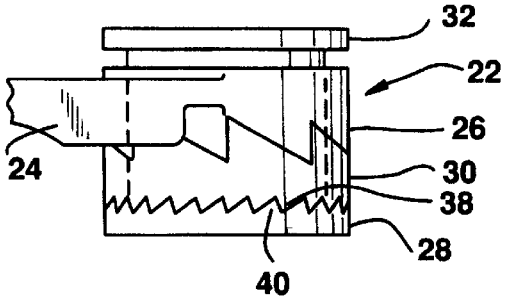
FIG.2 PRIOR ART
FIG. 2 is a side view of a prior art ratchet mechanism.

As illustrated in FIGS. 1 and 2, a conventional ratchet wrench, generally designated as 20, is illustrated. The wrench 20 illustrated is a style popularly known as a combination open end/box end wrench, in which the ratchet socket mechanism as been substituted for the normal box end configuration.

The conventional ratchet mechanism 22 (FIG. 2) comprises five main components. These are the handle 24, a driver ring 26, which may be permanently fixed to the handle 24 by welding or constructed as an integral part of the handle 24, a socket member 28 which is rotatably received within the driver ring 26, a pawl ring 30 which is rotatably carried on the socket member 28 and a retainer ring 32, fastened to the end of the socket member 28 that protrudes through the driver ring 26, in order to retain the parts in assembled condition.

The operation and construction of the ratchet mechanism is fully described in applicant's U.S. Pat. No. 4,030,384, issued Jun. 21, 1977, which is hereby incorporated by reference.

As shown in FIGS. 3–7, the improved ratchet mechanism of the present invention, generally designated 50, includes a handle or driver body 52, a driver ring 54, fixed to the handle 52 as previously, a socket member 56, which is rotatably received within the driver ring 54, and a pawl ring 58 which is rotatably carried on the socket member 56. A retainer ring 59 is fastened to the end 60 of the socket member 56 that protrudes through the driver ring 54, in order to retain the parts in the assembled condition, and a spring means 62 directly provides an axial force biasing the ratchet components into a compressed relationship. This spring means 62 is positioned between the retainer ring 59 and the driver ring 54, and directly encourages meshing of teeth 64, 66. The preferred form of the spring is a so-called wave washer, having at least three waves or nodes. The spring 62 may have a generally radially extending split 62S, which allows for its momentary expansion to allow it to be force fit over ring 59.

The socket member 56 has a set of driven ratchet teeth 66 formed therein near that one of its ends 78 about which the pawl ring 58 is fitted, and the pawl ring 58 similarly is provided with a set of driving ratchet teeth 64. When engaged, these teeth 64, 66 transmit driving force from the driver ring 54 through the pawl ring 58 to the socket member 56 and thence to a bolt or nut or intermediate member 80 (FIG. 7), engaged by the socket member 56. Preferably the teeth 64, 66 are typically of the configuration shown, having a generally symmetrical shape such that they will tend to transmit force equally when engaged in either direction.

Figure 7:
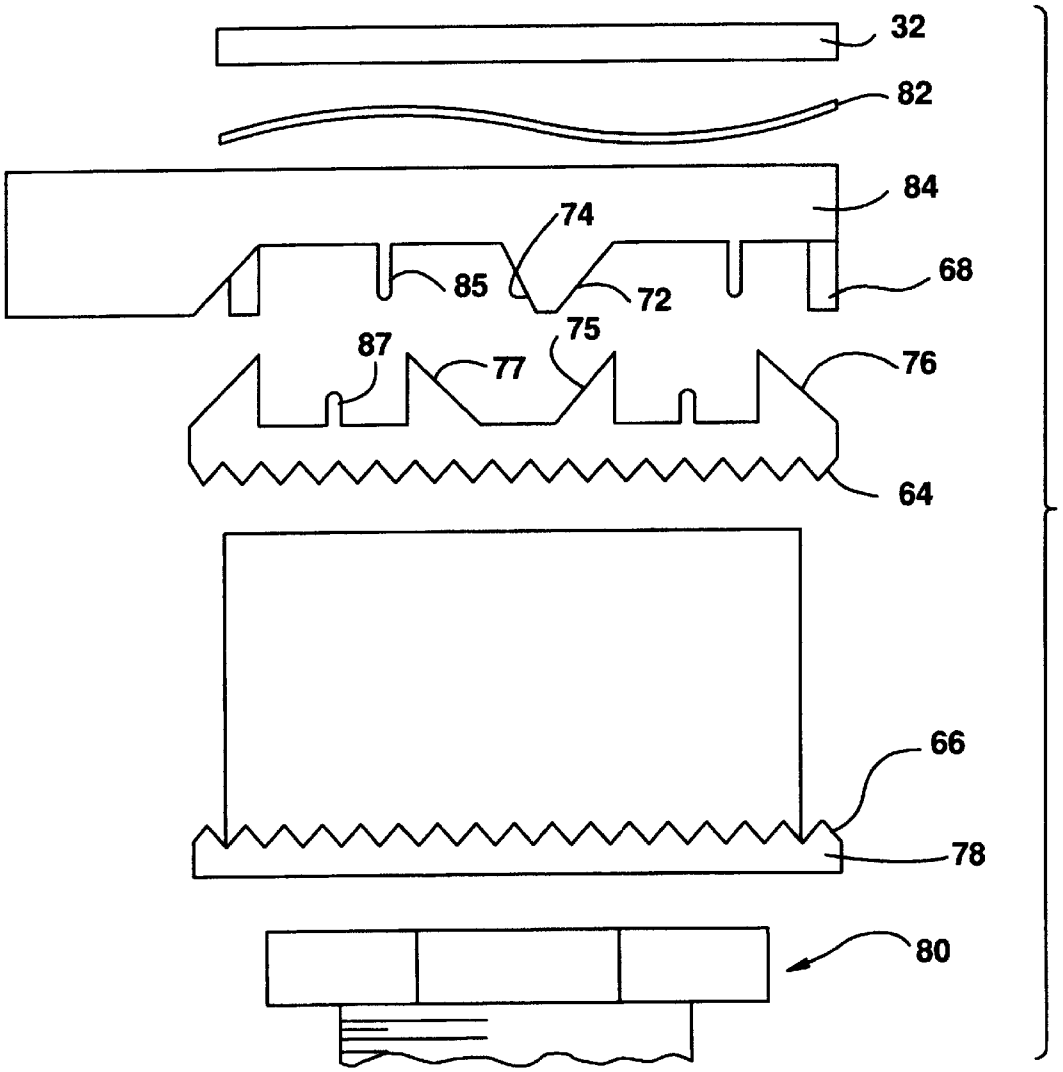
FIG. 7 is an exploded view of the parts with some parts broken away and shown in cross-section.

As shown in FIG. 7, the handle 52 extends to one side of the driver ring 54, with the axis of the circular opening through the driver ring 54 being preferably at right angles to the length of the handle 52. Control cam surfaces are formed on one face of the drive ring 54 preferably in the form of a set of teeth 68 having oppositely sloping faces 72 and 74. In addition, an angular first force feature or first tongue 85 is provided with essentially perpendicular faces.

Figure 3:
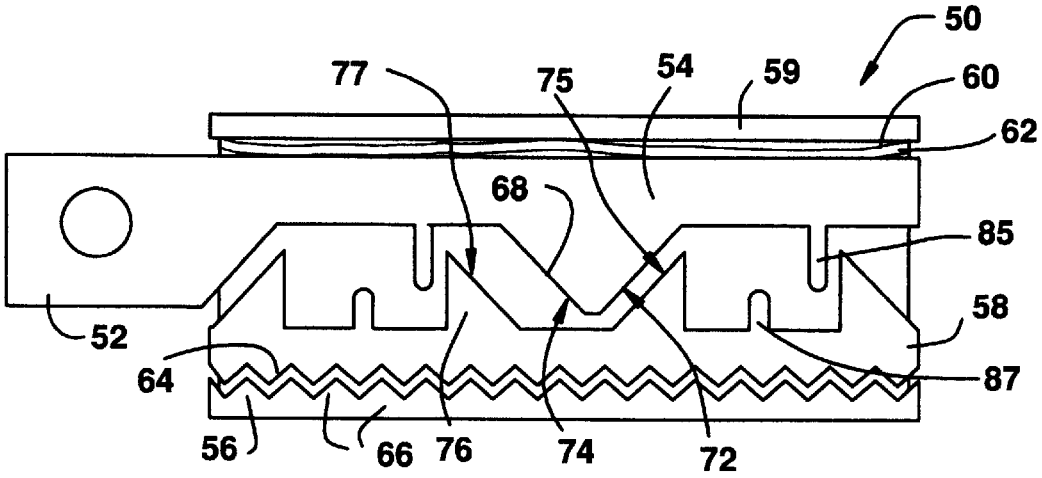
FIG. 3 is a view of the right end portion of the wrench, with the parts in position for driving in a counterclockwise direction, incorporating the present invention, as viewed from above.
Figure 4:
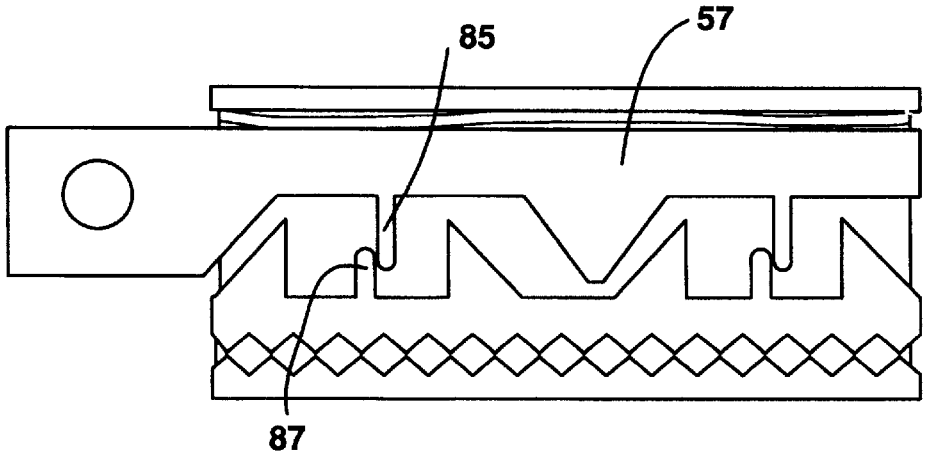
FIG. 4 is a view similar to FIG. 3 with the parts moved to show the mechanism in position for ratcheting in the clockwise direction as viewed from above.

The pawl ring 58 is provided with complementary control cam surfaces 76, having like sloping faces of opposite configuration, 75 and 77. In conjunction with the complementary cam surfaces there is provided an essentially perpendicular second angular force feature or second tongue 87. When the driver ring 54 is rotated in a direction with sloping face 72 leading in the direction of rotation and contacting sloping face 75 (as seen in FIG. 3), the two cam surfaces provide components of force tending to move the pawl ring 58 axially away from the driver ring 54, inducing engagement of the ratchet teeth 64 and 66. With opposite rotation of the driver ring 54, the angular force features (tongues) 85 and 87 connect and the driver ring imparts angular rotational force or torque to the pawl ring 58, which, as it then rotates with the driver ring 54, can retract toward and mate into the driver ring 54, disengaging the ratchet teeth 64 and 66 (FIG. 4).

Figure 5:
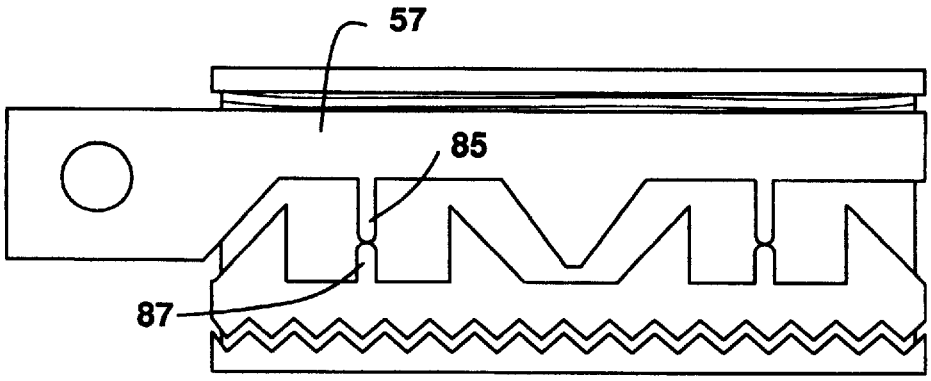
FIG. 5 is a view similar to FIG. 3 with the parts moved to show the mechanism in position to switch for driving in a clockwise direction, as viewed from above.
Figure 6:
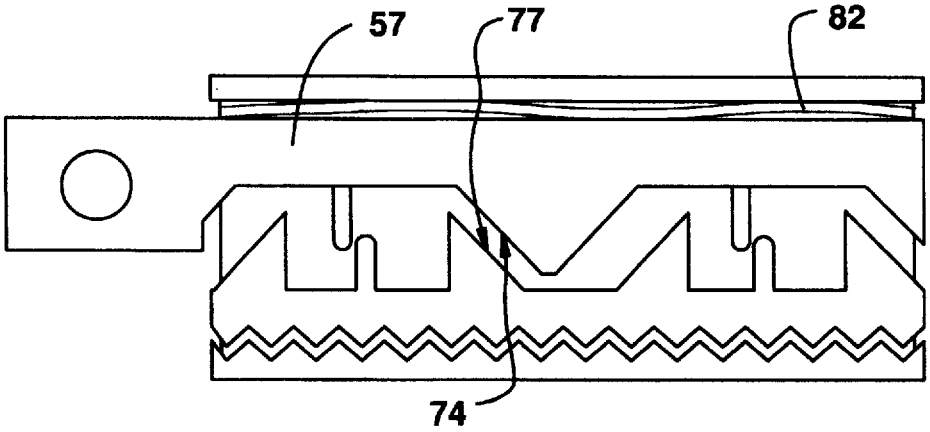
FIG. 6 is a view similar to FIG. 3 with the parts moved to show the mechanism in position for torque application in the clockwise direction as viewed from above.

With a force applied to the pawl ring 58 to engage ratchet teeth 64, 66 and prevent rotation with the driver 54, angular force features 85 and 87 may be slipped past each other, as shown in FIG. 5. FIG. 6 shows this action completed with the mechanism positioned for alternative performance. When the driver ring 54 is rotated in a direction with sloping face 74 leading in the direction of rotation and contacting surface 77, the two cam surfaces provide components of force again tending to move the pawl ring 58 axially away from the driver ring 54, inducing engagement of the ratchet teeth 64 and 66. With opposite rotation of the driver ring 54, the angular force features (tongues) 85 and 87 connect and the driver ring 54 imparts angular rotational force or torque to the pawl ring 58 in the opposite direction which again can retract toward and mate into the driver ring 54, disengaging the ratchet teeth 64 and 66.

The depth of the teeth 64, 66 is substantially less than the depth of the cam teeth 68, 76, thus axial movement of the pawl ring 58 toward and away from the driver ring 54 sufficient to engage and disengage the teeth 64, 66 will still not be enough to disengage the cam teeth 68, 76. The lengths of angular force features (tongues) 85 and 87 are chosen such that when the ratchet teeth 64 and 66 are engaged, the axial clearance available will be sufficient to permit angular force features or tongues 85 and 86 to slip past each other.

The spring means 62 is suitably fitted around the retainer ring 59 before or after the ring is welded to the end of socket member 56. When the parts are assembled, the spring means 62 seats between ring 59 and driver ring 54, and provides a direct axial force to bias the components of the ratchet mechanism 50 toward the socket member end 78 engaging teeth 66,68.

Thus, in the assembled condition, the socket member 56 extends through the pawl ring 58 and the driver ring 54 and is engaged by the retainer ring 59 which, preferably, may be permanently attached to the end 60 of the socket member 56 in order to capture the pawl ring 58 therein. The length of the socket member 56 and the relative dimensions of the other components are such that with the cam teeth 68, 76 and the driving/driven teeth 64, 66 fully engaged, the space 82 occupied by the uncompressed spring means 62 is slightly greater than the depth of the driving and driven teeth 64, 66.

Referring to FIGS. 3 and 7, if handle 52 is rotated in the counterclockwise direction as viewed from above, the resulting rotation of driver ring 54 will cause the cam teeth 68 to press against the cam teeth 76, assuming there is resistance to rotation to the socket member 56. This resistance will be normally provided by whatever part 80 is engaged by the socket member 56. The resultant force through the cams 68, 76 will move the teeth 64 of pawl ring 58 into engagement with the teeth 66 of the socket member 56, and it will in turn move slightly in an axial direction compressing the spring means 62 between the retainer ring 59 and the opposite or reverse face 84 of the driver ring 54.

With the mechanism 50 thus locked, torque will be transmitted to the socket member 56 and whatever part 80 it engages from the handle 52. Opposite movement of the handle 52, in other words clockwise rotation as viewed in FIG. 4 from above, will release the force through the cams 68 and 76, the angular force feature 85 will contact and impart angular force to angular force feature 87, rotationally driving the pawl ring 58 with the driver ring 54. The pawl ring 58 will tend to move toward the driver ring 54 due to the sloping configuration of the teeth 64, 66 compressing the spring means 62 between the driver ring 54 and the retainer ring 59. Compression of the spring means 62 and movement of the pawl ring 58 away from the working end 78 of the socket member 56 will disengage the teeth 64, 66

Upon reversal of the handle 52 to re-apply torque, the spring means 62 will exert an axial force which tends to mate the cam means 68, 76 and the teeth 64, 66. As soon as resistance is met in the socket area, the driver ring 54 will move toward the retainer ring 59 compressing the spring means 62 and the teeth 64, 66 will remain in the meshed relationship.

Referring to FIGS. 5 and 6, torque application direction of the mechanism may be reversed. If, instead of reversal of the handle 52 to re-apply torque, the pawl ring 58 is held from rotation, as by manually gripping it into an engaged condition of teeth 64, 66, and the driver ring 54 is additionally rotated in the clockwise direction as viewed from above, angular force features 85, 87 may be slipped past each other. In this configuration, clockwise rotation of the driver ring as viewed from above will bring cams 68, 76 again into contact, but now the interaction of sloping faces 74, 77 will generate the axial forces to lock the mechanism for torque application, now in the clockwise direction as viewed from above. Ratcheting will be accomplished as above described, but in the opposite direction.

It will be seen from the foregoing that the ratchet mechanism 50 thus provided in a socket wrench or the like is simple in construction and operation, relatively easy to manufacture, structurally reliable and small in size so that it is not appreciably larger than an ordinary box-end wrench. The addition of the angular force features 85, 87 and the accommodating geometry provides for easily accomplished torque reversal without the necessity of flipping over the mechanism.

While the method and form of apparatus herein described constitutes a preferred embodiment of this invention, it is to be understood that the invention is not limited to this precise method and form of apparatus, and that changes may be made therein without departing from the scope of the invention which is defined in the appended claims.

What is claimed is:

1. A ratchet mechanism comprising:

a rotatable driver body (52);

a driver ring (54) fastened to said body for rotation thereby in forward and reverse directions, said driver ring having opposite faces and a circular opening;

driver cam teeth (68) projecting from one face of said driver ring, said driver cam teeth having opposed oppositely sloping faces 72,74 and;

a first tongue (85) also extending from said one face of said driver ring spaced angularly between said driver ring cam teeth to impart angular force, said first tongue having faces extending essentially perpendicular to said driver ring;

a socket member (56) having an outer circular surface configuration matched to said opening in said driver ring and an inner surface configuration of irregular shape for engaging with an item to be rotated thereby, said socket member being rotatably fitted within said driver ring;

a pawl ring (58) surrounding said socket member and having first and second faces, driven ring cam teeth (76) extending from said first face of said pawl ring and engagable with said driver ring cam teeth (68) on adjacent driver ring, said driven ring cam teeth having oppositely sloping faces 75,77 spaced apart a distance greater than the width of said driver cam teeth 68 between said sloping faces thereof 72,74 whereby said driver cam teeth can enter the space between said sloping faces of said driven ring cam teeth;

a series of driven teeth (66) around said socket member and having tooth faces located facing toward said pawl ring;

said pawl ring also having a series of driving teeth (64) extending from said second face of said pawl ring and engagable with said driven teeth (66) of said socket member, said cam teeth (68, 76) having a rise greater than the depth of said driving and driven teeth (64,66);

a second tongue (87) extending from said first face of said pawl ring in angularly spaced relation to said driven ring cam tooth (76), said second tongue having faces extending essentially perpendicular to said pawl ring for receiving angular force from said first tongue (85);

a retainer (59) on said socket member extending in opposed relation to the other face of said driver ring; and spring means (62), positioned between said retainer and said driver ring, for biasing said driver ring and said pawl ring toward said socket member such that said driven teeth (66) and said driving teeth (64) tend to mesh.

2. A ratchet mechanism as defined in claim 1, wherein said tongues project perpendicularly from said one face of said driver ring and from said first face of said pawl ring, respectively.

3. A ratchet mechanism as defined in claim 2, wherein said tongues (85,87) have a length less than the height of said cam teeth such that, when said cam teeth (68, 76) are engaged, there is sufficient axial clearance to permit said tongues to pass each other in angular rotation.

* * * * *